US010918202B1

(12) United States Patent
Sie

(10) Patent No.: US 10,918,202 B1
(45) **Date of Patent: *Feb. 16, 2021**

(54) LIFTING TABLE

(71) Applicant: Fong-Lung Sie, Tainan (TW)

(72) Inventor: Fong-Lung Sie, Tainan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/663,580

(22) Filed: Oct. 25, 2019

(51) Int. Cl.
*A47B 9/06* (2006.01)
*A47B 9/02* (2006.01)
*A47B 21/02* (2006.01)

(52) U.S. Cl.
CPC ..... *A47B 9/06* (2013.01); *A47B 9/02* (2013.01); *A47B 21/02* (2013.01)

(58) Field of Classification Search
CPC .... A47B 9/06; A47B 9/02; A47B 9/04; A47B 9/00; A47B 2009/065; A47B 21/02; A47C 3/40; A47C 3/30
USPC ..... 108/147, 144.11, 147.19; 248/188.2, 248/188.5
See application file for complete search history.

(56) References Cited

U.S. PATENT DOCUMENTS 3,080,835 A * 3/1963 Guglielmi ..... A47B 9/10 108/116
5,020,752 A * 6/1991 Rizzi ..... A47B 9/02 108/146
5,370,063 A * 12/1994 Childers ..... A47B 9/06 108/143
5,408,940 A * 4/1995 Winchell ..... A47B 9/06 108/10
5,549,053 A * 8/1996 Grout ..... A47B 9/06 108/147
6,345,547 B1 * 2/2002 Stoelinga ..... A47B 9/06 108/147
7,412,931 B2 * 8/2008 Seidl ..... A47B 9/02 108/147
10,321,755 B1 * 6/2019 Sie ..... A47B 9/06
10,531,732 B1 * 1/2020 Huang ..... A47B 9/20
2009/0044735 A1 * 2/2009 Nielsen ..... A47B 9/06 108/147.19
2011/0023758 A1 * 2/2011 Overgaard ..... A47B 9/06 108/147
2016/0095425 A1 * 4/2016 Yang ..... A47B 9/06 248/188.2
2016/0345722 A1 * 12/2016 Chen ..... A47B 9/04
2017/0224101 A1 * 8/2017 Bruder ..... A47B 13/06
2017/0303679 A1 * 10/2017 Tseng ..... A47B 9/04
2018/0055214 A1 * 3/2018 Kim ..... A47B 9/10
2018/0213927 A1 * 8/2018 Sudoh ..... A47B 21/02
(Continued)

*Primary Examiner* — Jose V Chen
(74) *Attorney, Agent, or Firm* — Rosenberg, Klein & Lee

(57) ABSTRACT

A lifting table is disclosed herein. It comprises a table board; two legs, each having a hollow outer column and a hollow inner column connected to a table board, a first guiding seat connected to a bottom of the hollow inner column and having a first guiding wheel for contacting an inner wall of the hollow outer column, a second guiding seat disposed at an top of the hollow outer column and having a second guiding wheel for contacting an outer wall of the hollow inner column; and a height adjusting apparatus having a gas spring inserted into the hollow inner column of each of the two legs and a control portion disposed on a top of the gas spring. A bottom and a top of the gas spring are respectively connected to a bottom of the hollow outer column and a top of the hollow inner column.

6 Claims, 9 Drawing Sheets

(56) References Cited

U.S. PATENT DOCUMENTS

| | | | | |
|---|---|---|---|---|
| 2019/0069669 | A1* | 3/2019 | Hall | A47B 21/06 |
| 2019/0082823 | A1* | 3/2019 | Applegate | A47B 3/08 |
| 2020/0085184 | A1* | 3/2020 | Lu | A47B 9/20 |

* cited by examiner

LIFTING TABLE

BACKGROUND OF THE INVENTION

1. Field of the Invention

The present invention relates to a lifting table which assembles conveniently and adjusts a height of the lifting table smoothly by non-tilted elevating or lowering a table board thereof so as to achieve effects of diverse application by different users and increase practicality in its overall application.

2. Description of Related Art

The U.S. Ser. No. 10/321,455 (B1), issued on 18 Jun. 2019, discloses an elevating apparatus of a table. It mainly comprises a board, two legs and a height adjusting apparatus. The two legs are connected to two lateral members disposed at a bottom of the board respectively and each has a leg base at a bottom thereof, a hollow outer column disposed on the leg base and having a guide rail disposed on at least one internal side thereof, a teeth-guiding slot and a pulley slot disposed at two corresponding sides thereof adjacent to the at least one internal side, and an inner column movably inserted into the hollow outer column and connected to the board at a top side thereof. The height adjusting apparatus comprises a gas spring inserted into the inner column of each of the two legs, a chute disposed outside the inner column and corresponding to the guide rail of the hollow outer column, plural arc portions equally spaced apart from each other at two laterals of the chutes for contacting the guide rail, a gear rack disposed at the inner column for correspondingly engaging with the guide gear, and a pulley pivotally connected to the pulley slot of the hollow outer column for contacting the inner column.

Although the abovementioned elevating apparatus of a table achieves effects of adjusting height of the table, the overall structural design of the elevating apparatus of a table is complicated due to the guide rail in the hollow outer column, the chute outside the inner column corresponding to the guide rail, the guide gear and the gear rack disposed between the hollow outer column and the inner column for engaging with each other, and the pulley pivotally connected to the hollow outer column for contacting the inner column. Therefore, the elevating apparatus of a table is not easy to assemble, prone to damage and has a high production cost, and improvement of a whole design of the aforementioned elevating apparatus of a table is needed.

SUMMARY OF THE INVENTION

The present invention relates to a lifting table which assembles conveniently and adjusts a height of the lifting table smoothly by non-tilted elevating or lowering a table board thereof so as to achieve effects of diverse application by different users and increase practicality in its overall application.

DETAILED DESCRIPTION OF THE PREFERRED EMBODIMENT

Figure 1:
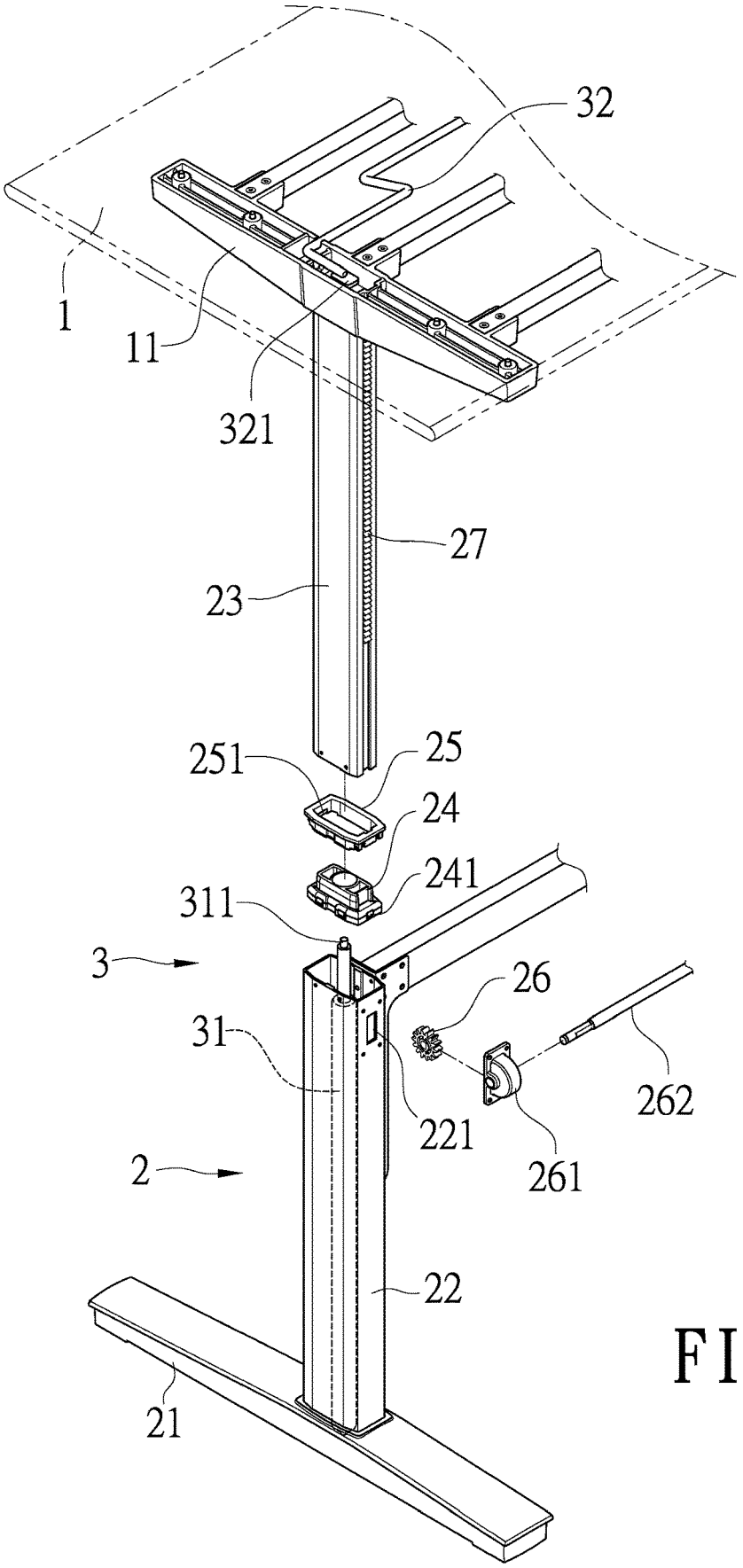
FIG. 1 is an exploded diagram showing a first embodiment for a lifting table of the present invention.
Figure 2:
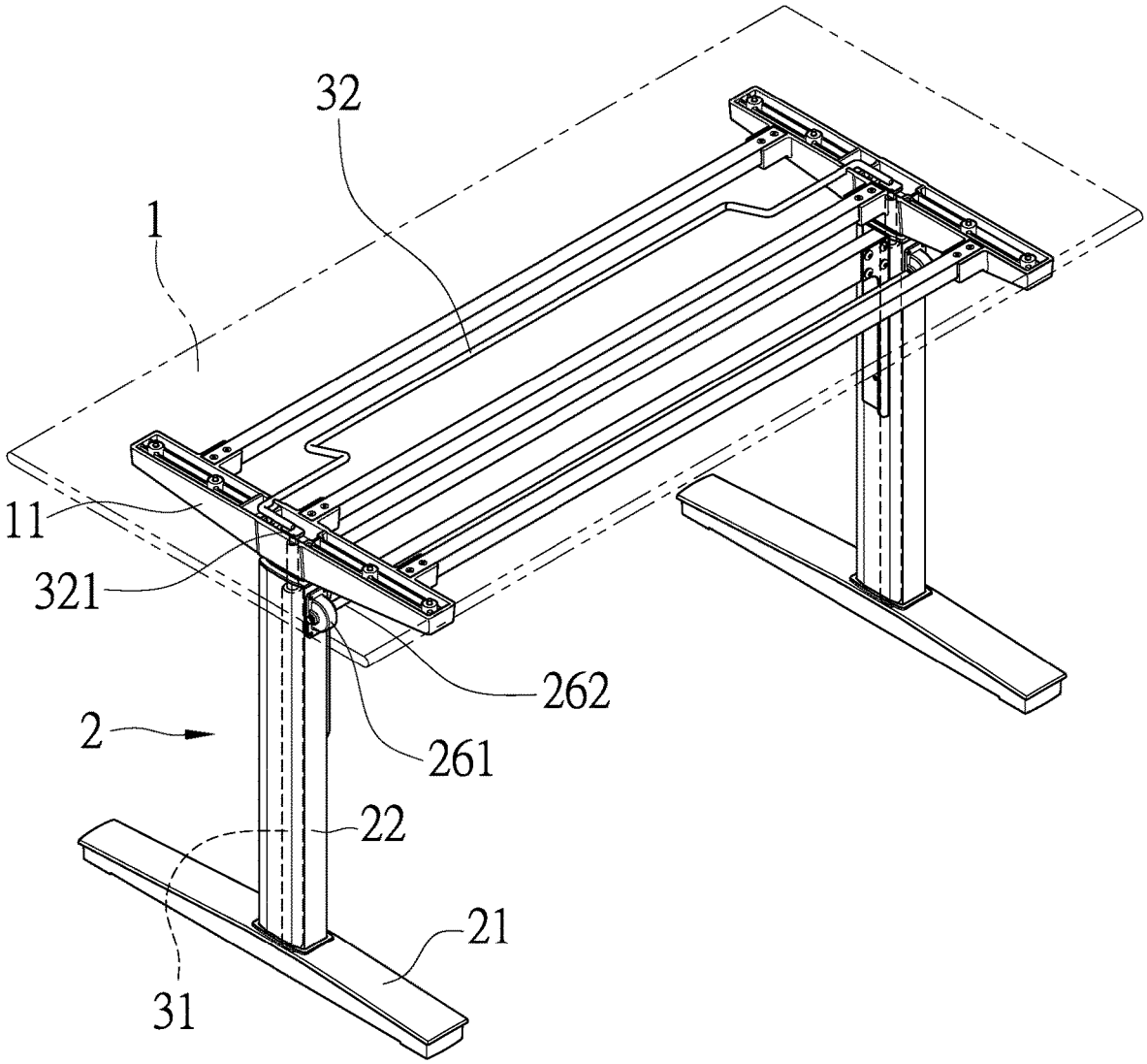
FIG. 2 is a stereogram showing a lifting table of the present invention in assembly.
Figure 3:
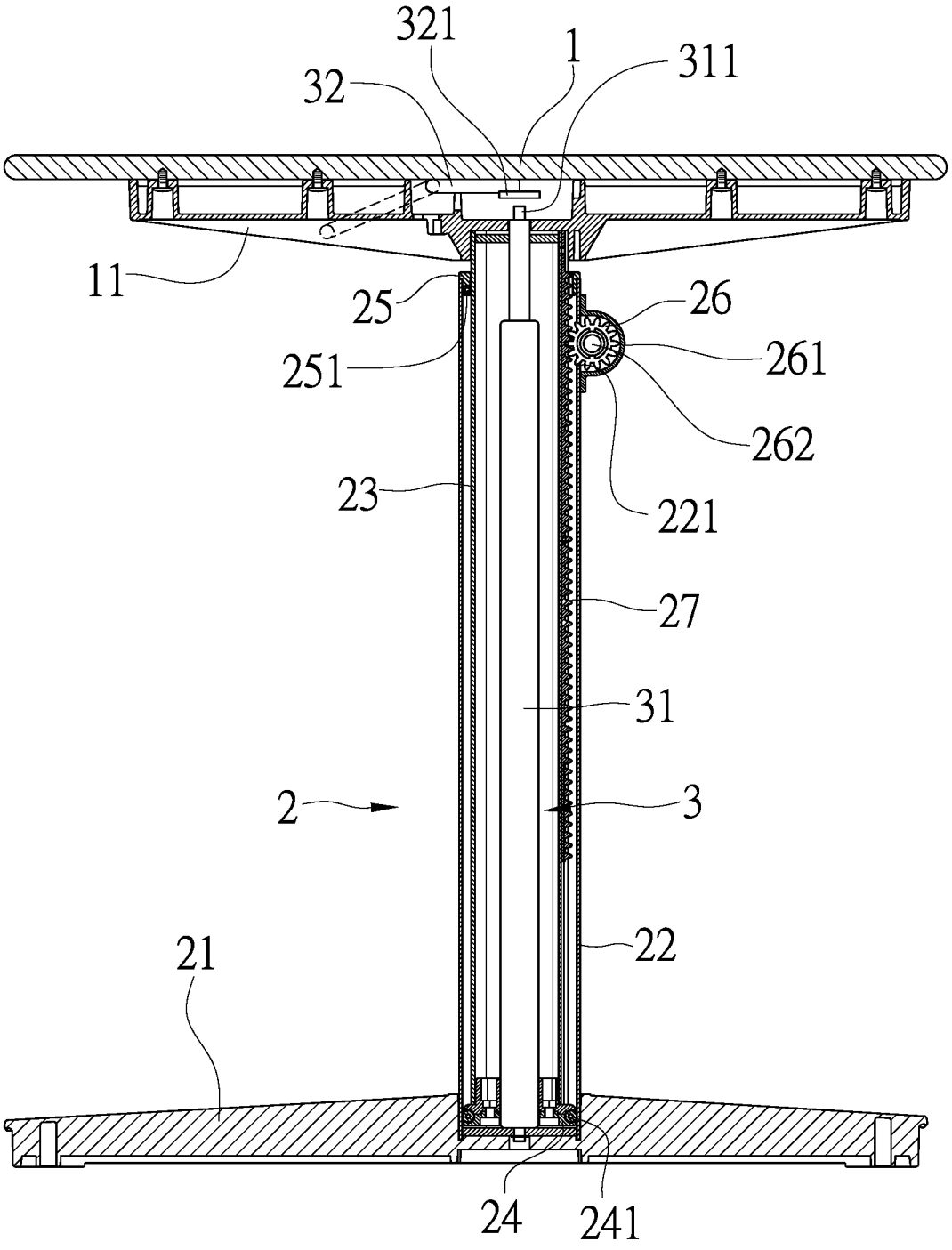
FIG. 3 is a sectional diagram showing a lifting table of the present invention in assembly.

Referring to FIG. 1, FIG. 2 and FIG. 3, the lifting table of the present invention comprises a table board (1), two legs (2) and a height adjusting apparatus (3).

The table board (1) has two lateral members (11) at a bottom thereof.

Figure 4:
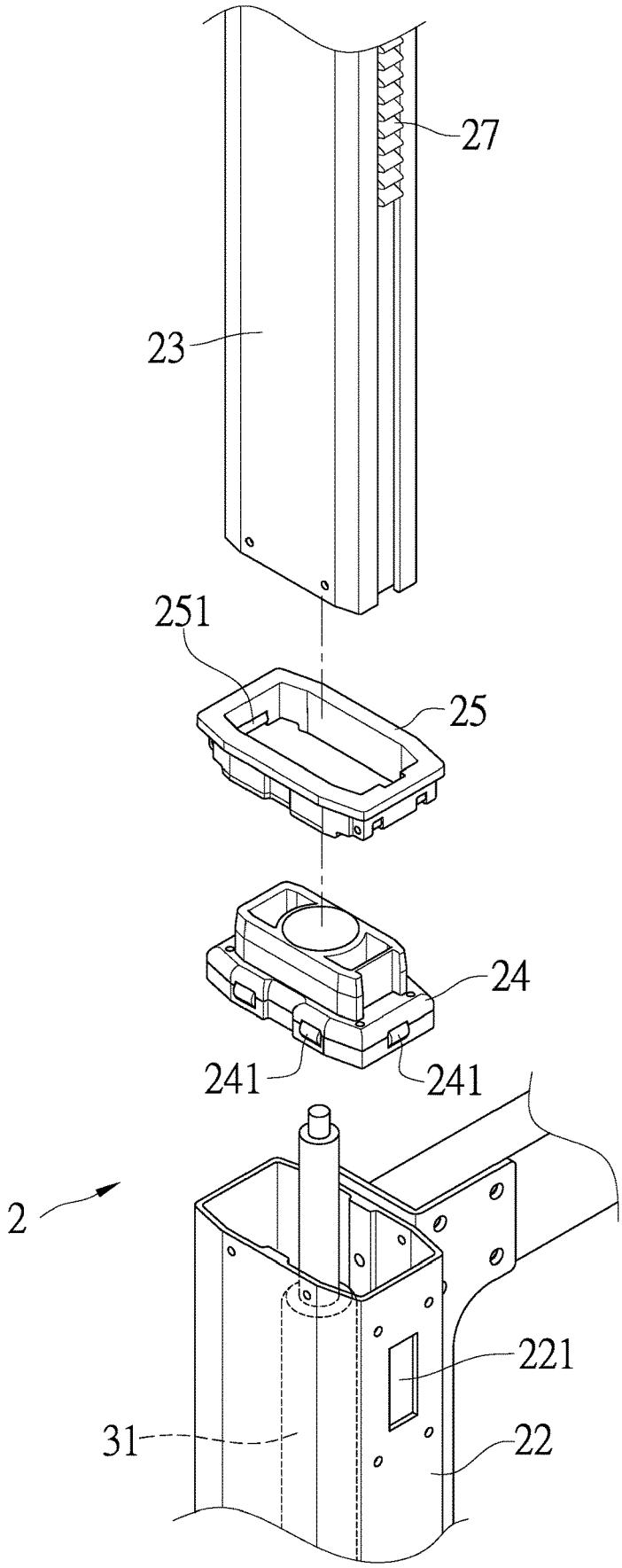
FIG. 4 is a partial exploded diagram showing a leg of a lifting table of the present invention.
Figure 5:
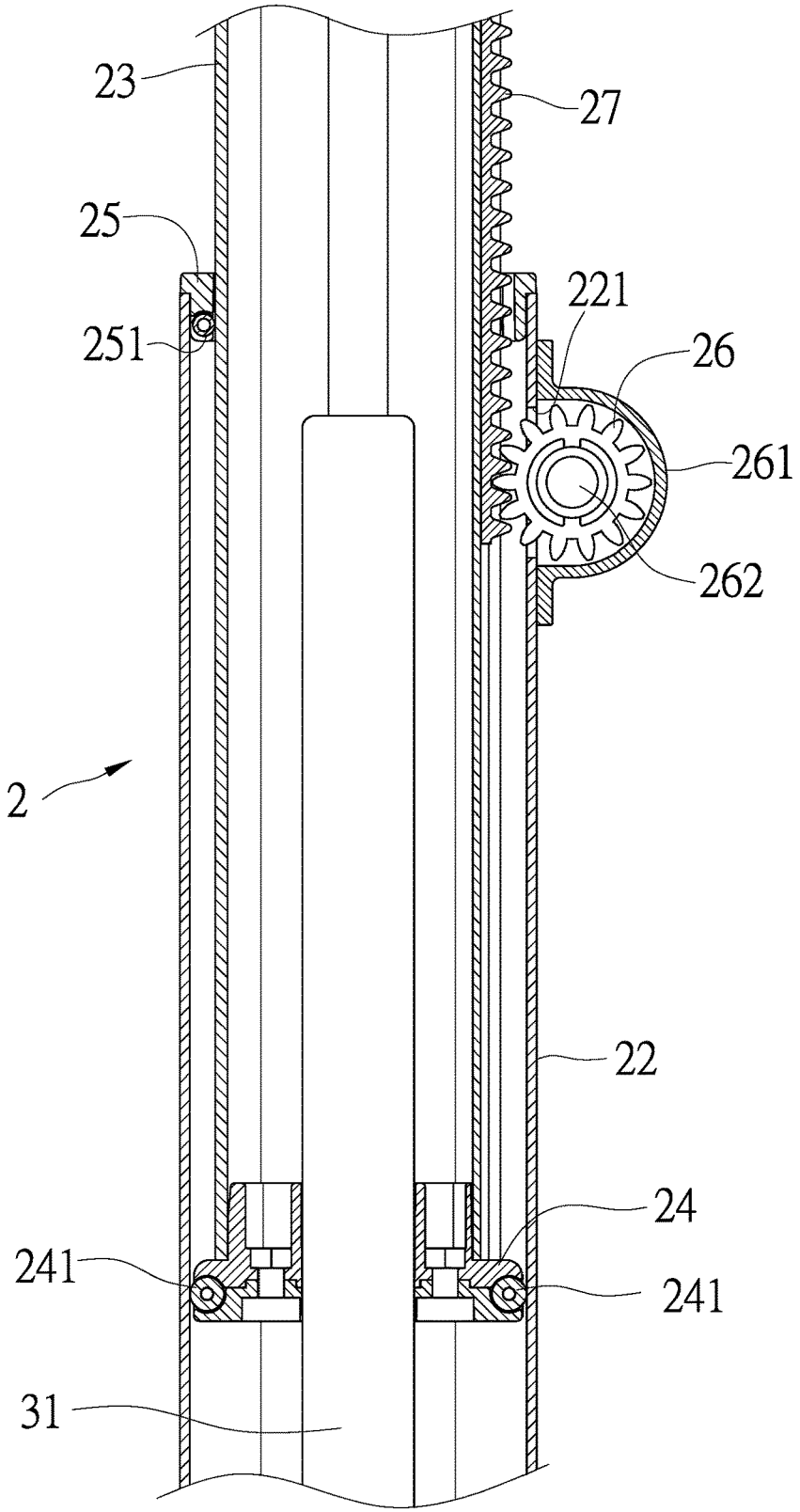
FIG. 5 is a partial sectional diagram showing a leg of a lifting table of the present invention in assembly.

The two legs (2) are connected to the two lateral members (11). Please refer to FIG. 4 and FIG. 5, each of the two legs (2) has a leg base (21) at a bottom thereof, a hollow outer column (22) disposed on the leg base (21), a hollow inner column (23) movably inserted into the hollow outer column (22), a first guiding seat (24) connected to a bottom of the hollow inner column (23), and a second guiding seat (25) disposed at a top of the hollow outer column (22). The hollow inner column (23) is connected to the table board (1) at a top side. The first guiding seat (24) has a first guiding wheel (241) at an outer edge thereof for contacting an inner wall of the hollow outer column (22), and the second guiding seat (25) has a second guiding wheel (251) at an inner edge thereof for contacting an outer wall of the hollow inner column (23). The hollow outer column (22) comprises a slot (221) at one lateral thereof and a guiding gear (26) pivotally connected to the slot (221) of the hollow outer column (22). The guiding gear (26) is provided with a protecting cover (261), and the two guiding gears (26) pivotally connected to the two hollow outer columns (22) of the two legs (2) are connected by a wheel shaft (262). The hollow inner column (23) has a guiding gear rack (27) disposed on a lateral side thereof corresponding to the slot (221) of the hollow outer column (22) for engaging with the guiding gear (26).

The height adjusting apparatus (3) has a gas spring (31) and a control portion (311) disposed on a top of the gas spring (31). The gas spring (31) is inserted into the hollow inner column (23) of each of the two legs (2). A bottom of the gas spring (31) is connected to a bottom of the hollow outer column (22), and a top of the gas spring (31) is connected to a top of the hollow inner column (23). An elevating control lever (32) is further provided for connecting the two hollow inner columns (23) of the two legs (2), and the elevating control lever (32) has two first pressing members (321) at two ends thereof corresponding to the two control portions (311) of the two gas springs (31).

Figure 6:
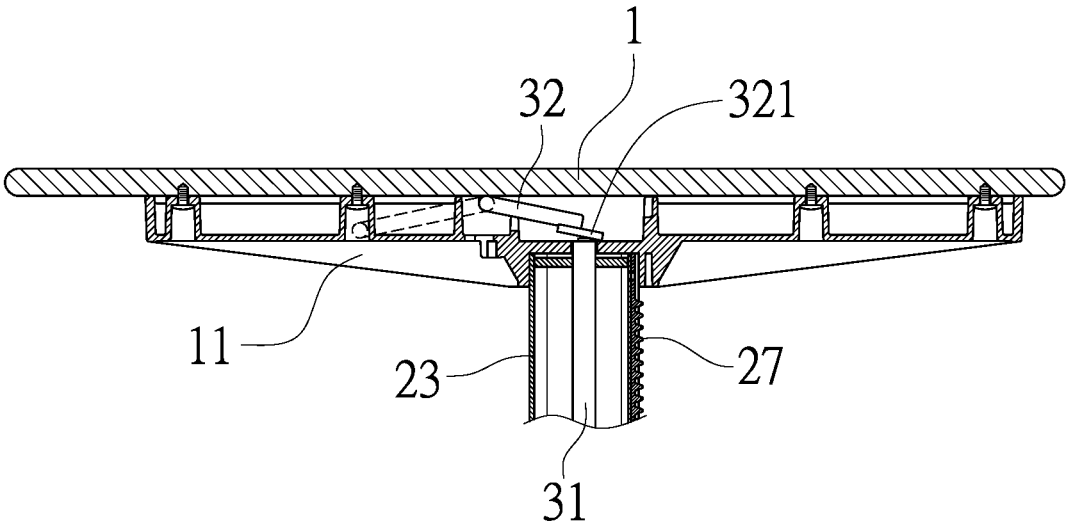
FIG. 6 is a schematic diagram showing a controlling process of a lifting table of the present invention.
Figure 7:
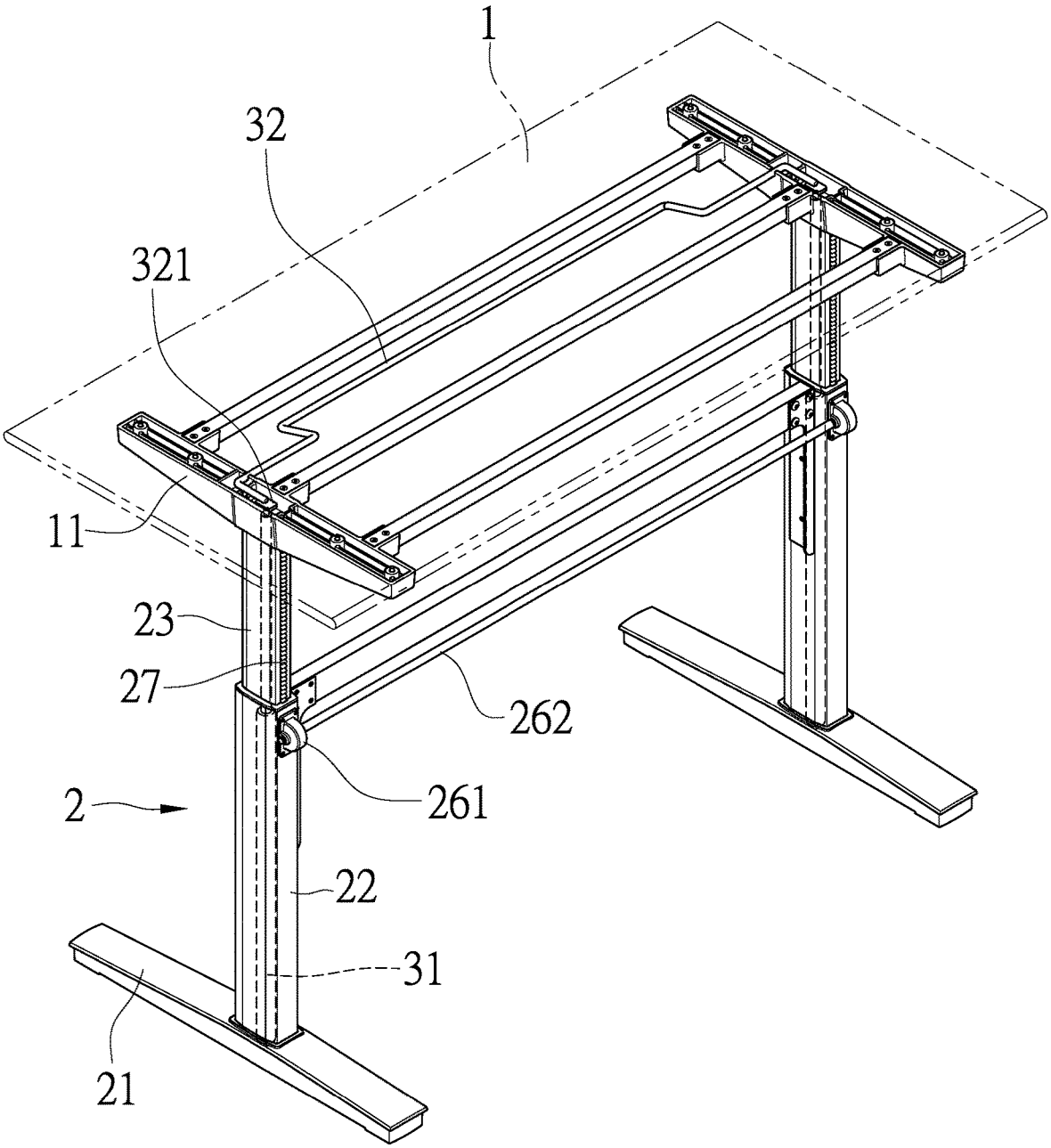
FIG. 7 is a stereogram showing a lifting table of the present invention in an elevated state.
Figure 8:
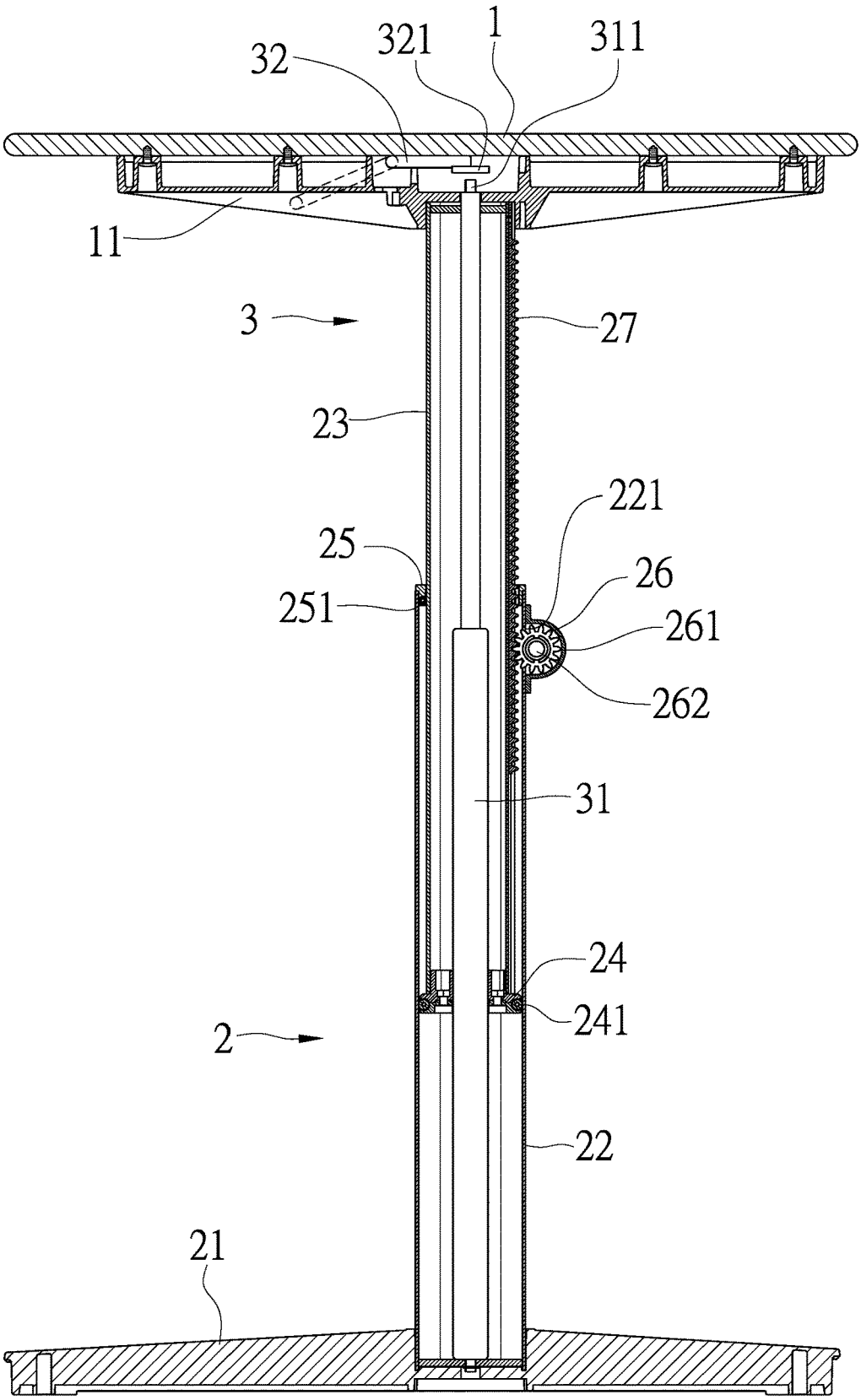
FIG. 8 is a sectional diagram showing a lifting table of the present invention in an elevated state.

Referring to FIG. 6, to adjust a height of the table board (1) of the present invention, the elevating control lever (32) of the height adjusting apparatus (3) is pulled and the two control portions (311) of the two gas springs (31) are pressed by the two first pressing members (321) of the elevating control lever (32). Then, the hollow inner column (23) and the table board (1) are driven to lift by the gas springs (31). The first guiding wheel (241) of the first guiding seat (24) is contacted to an inner wall of the hollow outer column (22)

and the second guiding wheel (251) of the second guiding seat (25) is contacted to an outer wall of the hollow inner column (23), so the hollow inner column (23) can be moved in the hollow outer column (22) smoothly due to a sliding of the first guiding wheel (241) along the inner wall of the hollow outer column (22) and a sliding of the second guiding wheel (251) along the outer wall of the hollow inner column (23). In addition, the two hollow inner columns (23) are moving in the two hollow outer columns (22) synchronously and non-tiltedly for height adjustment due to an engagement of the guiding gear rack (27) on the hollow inner column (23) with the guiding gear (26) pivotally connected to the slot (221) of the hollow outer column (22) and a connection of the two guiding gears (26) of the two legs (2) by the wheel shaft (262). Referring to FIG. 7 and FIG. 8, after the table board (1) is adjusted to a height needed, the elevating control lever (32) is released and the height of the table board (1) is fixed by the gas springs (31).

Figure 9:
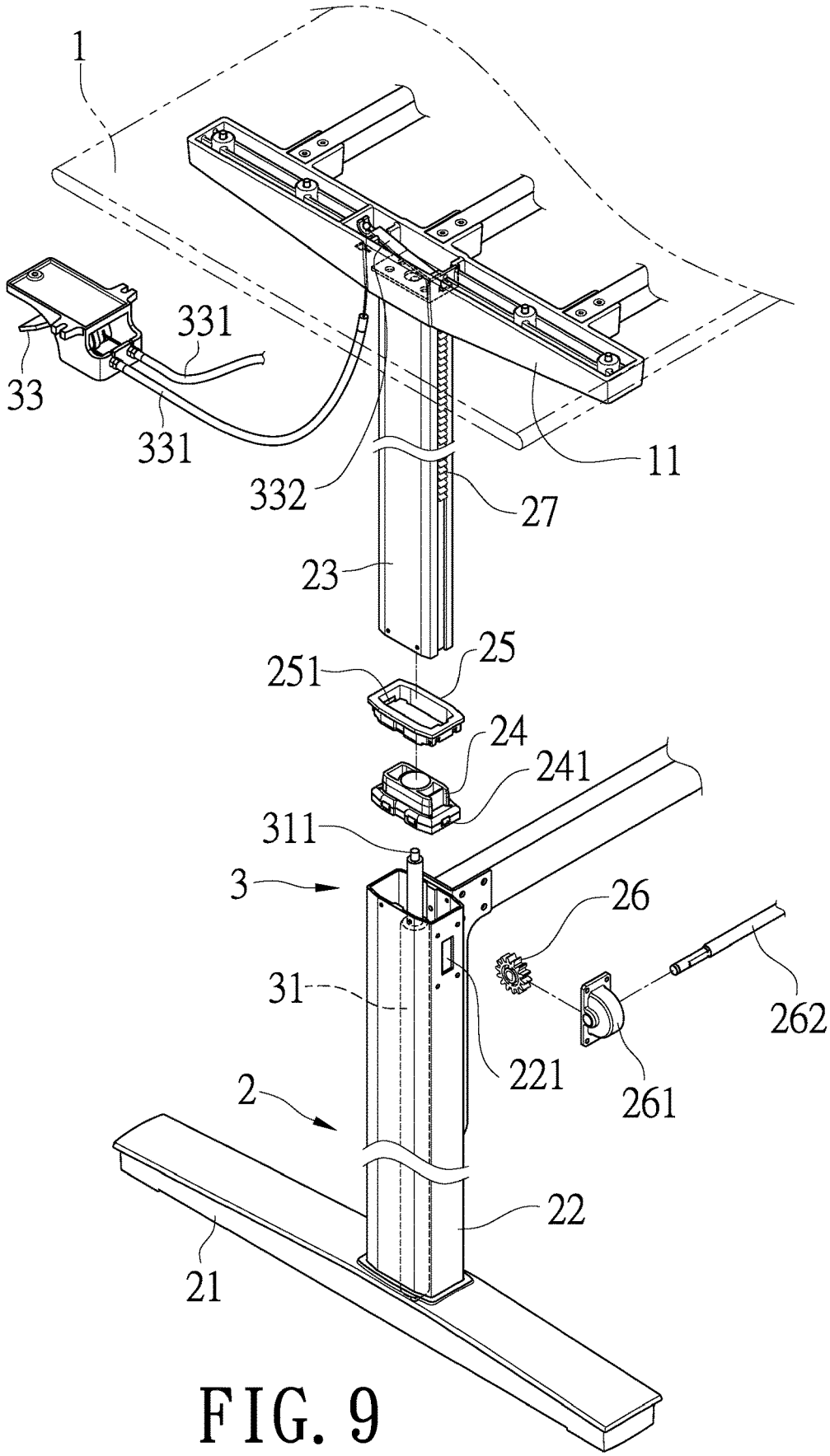
FIG. 9 is an exploded diagram showing a second embodiment for a lifting table of the present invention.

Referring to FIG. 9, in a second embodiment of the present invention, the height adjusting apparatus (3) comprises a controlling switch (33). The controlling switch (33) has two strings (331) and two second pressing members (332) corresponding to the two control portions (311) of the two gas springs (31), and the two strings (331) are respectively connected to the two second pressing members (332). To adjust the height of the table board (1), the two strings (331) are pulled simultaneously by operating the controlling switch (33) for pulling the two second pressing members (332), and then the two control portions (311) of the two gas springs (31) are pressed by the two second pressing members (322) respectively to drive the hollow inner column (23) and the table board (1) lifting to a height needed.

Compared to the existing lifting table, the present invention assembles conveniently and adjusts a height of a lifting table smoothly by non-tilted elevating or lowering a table board of the lifting table. Therefore, the present invention achieves effects of diverse application by different users and increases practicality in its overall application.

What is claimed is:

1. A lifting table, comprising:

a table board having two lateral members disposed at a bottom thereof;

two legs connected to the two lateral members of the table board respectively, each having a leg base at a bottom thereof, a hollow outer column disposed on the leg base, a hollow inner column movably inserted into the hollow outer column and connected to the table board at a top side thereof, a first guiding seat connected to a bottom of the hollow inner column and having a first guiding wheel at an outer edge thereof for contacting an inner wall of the hollow outer column, and a second guiding seat disposed at a top of the hollow outer column and having a second guiding wheel at an inner edge thereof for contacting an outer wall of the hollow inner column; and a height adjusting apparatus having a gas spring inserted into the hollow inner column of each of the two legs and a control portion disposed on a top of the gas spring, wherein a bottom of the gas spring is connected to a bottom of the hollow outer column and a top of the gas spring is connected to a top of the hollow inner column.

2. The lifting table as claimed in claim 1, wherein the hollow outer column of each of the two legs has a slot at one lateral thereof and a guiding gear pivotally connected to the slot thereof, and wherein the hollow inner column has a guiding gear rack disposed on a lateral side thereof corresponding to the slot of the hollow outer column for engaging with the guiding gear.

3. The lifting table as claimed in claim 2, wherein the guiding gear of each of the two legs is provided with a protecting cover.

4. The lifting table as claimed in claim 2, further comprising a wheel shaft for connecting the two guiding gears pivotally connected to the two hollow outer columns of the two legs.

5. The lifting table as claimed in claim 1, further comprising an elevating control lever for connecting the two hollow inner columns of the two legs, and wherein the elevating control lever has two first pressing members at two ends thereof corresponding to the two control portions of the two gas springs.

6. The lifting table as claimed in claim 1, wherein the height adjusting apparatus has a controlling switch, and wherein the controlling switch has two strings and two second pressing members corresponding to the two control portions of the two gas springs for connecting the two strings respectively.

* * * * *